US012083591B2

(12) United States Patent
Guillemin et al.

(10) Patent No.: US 12,083,591 B2
(45) Date of Patent: Sep. 10, 2024

(54) MOULD POWDER AND MOULD COATING

(71) Applicant: ELKEM ASA, Oslo (NO)

(72) Inventors: Francois Guillemin, Ligny en Barrois (FR); Mourad Toumi, Saint Maximin (FR)

(73) Assignee: ELKEM ASA, Oslo (NO)

( * ) Notice: Subject to any disclaimer, the term of this patent is extended or adjusted under 35 U.S.C. 154(b) by 651 days.

(21) Appl. No.: 17/297,884

(22) PCT Filed: Nov. 28, 2019

(86) PCT No.: PCT/NO2019/050261
§ 371 (c)(1),
(2) Date: May 27, 2021

(87) PCT Pub. No.: WO2020/111948
PCT Pub. Date: Jun. 4, 2020

(65) Prior Publication Data

US 2022/0032365 A1 Feb. 3, 2022

(30) Foreign Application Priority Data

Nov. 29, 2018 (FR) ..... 1872082

(51) Int. Cl.
*B22F 1/05* (2022.01)
*B22C 3/00* (2006.01)
*B22D 13/10* (2006.01)

(52) U.S. Cl.
CPC ..... *B22F 1/05* (2022.01); *B22C 3/00* (2013.01); *B22D 13/102* (2013.01); *B22F 2301/056* (2013.01); *B22F 2301/35* (2013.01); *B22F 2302/45* (2013.01)

(58) Field of Classification Search
CPC . B22C 3/00; B22D 13/102; B22F 1/05; B22F 2301/056; B22F 2301/35; B22F 2302/45; B22F 1/105
See application file for complete search history.

(56) References Cited

U.S. PATENT DOCUMENTS

| | | | |
|---|---|---|---|
| 4,058,153 | A | 11/1977 | Pierrel |
| 6,102,983 | A | 8/2000 | Skaland |
| 7,615,095 | B2 | 11/2009 | Margaria |
| 2005/0066771 | A1 | 3/2005 | Margaria |
| 2019/0169705 | A1 | 6/2019 | Knustad |
| 2019/0203308 | A1 | 7/2019 | Skaland et al. |

FOREIGN PATENT DOCUMENTS

| | | | |
|---|---|---|---|
| AR | 017822 | A1 | 10/2001 |
| CN | 102251169 | B | 1/2013 |
| CN | 105132788 | B | 5/2017 |
| JP | S43-001737 | A | 1/1968 |
| JP | S46-012620 | A | 5/1971 |
| JP | H03-130344 | A | 6/1991 |
| JP | H04-308018 | A | 10/1992 |
| JP | H06-246415 | A | 9/1994 |
| JP | 2001-269767 | A | 10/2001 |
| JP | 2006-207125 | A | 8/2006 |
| JP | 2008-536688 | A | 9/2008 |
| RU | 2172782 | C1 | 8/2001 |
| SU | 499935 | A1 | 1/1976 |
| WO | 9929911 | A1 | 6/1999 |
| WO | 2006068487 | A1 | 6/2006 |
| WO | 2018004356 | A1 | 1/2018 |
| WO | 2018004357 | A1 | 1/2018 |

OTHER PUBLICATIONS

International Search Report for Application No. PCT/NO2019/050261 mailed Jan. 30, 2020.
French Search Report for Application No. FR 1872082 mailed Nov. 9, 2019.
Federal Service for Intellectual Property Search Report for Application No. PCT/CN2019/050261 completed Oct. 15, 2021.

*Primary Examiner* — Anthony J Green
(74) *Attorney, Agent, or Firm* — McBee Moore & Vanik IP, LLC

(57) ABSTRACT

The present invention relates to a mould powder for coating cast moulds for reducing surface defects, such as pinholes, in ductile cast iron products. The mould powder comprises 10-99.5% by weight of a ferrosilicon alloy, 0.5-50% by weight of iron sulphide, and optionally 1-30% by weight of CaSi, and/or 1-10% by weight of $CaF_2$. The invention further relates to a mould coating on and internal surface of a casting mould comprising 10-99.5% by weight of a ferrosilicon alloy, 0.5-50% by weight of iron sulphide, and optionally 1-30% by weight of CaSi, and/or 1-10% by weight of $CaF_2$.

23 Claims, 1 Drawing Sheet

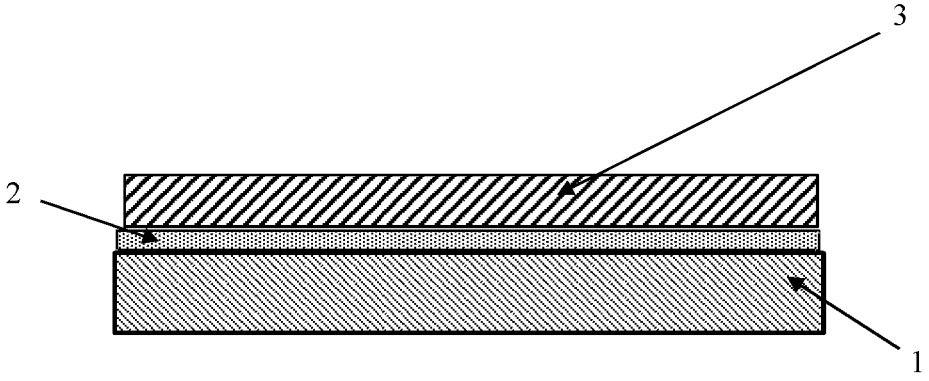
3
2
1

MOULD POWDER AND MOULD COATING

CROSS-REFERENCE TO RELATED APPLICATIONS

This application is the National Stage entry of International Application No. PCT/NO2019/050261, filed 28 Nov. 2019, which claims priority to French Application No. 1872082, filed 29 Nov. 2018.

BACKGROUND

Technical Field

The present invention relates to a mould powder for coating internal mould surface used in casting of ductile cast iron and to a mould coating on an internal surface of a casting mould.

BACKGROUND ART

Ductile iron pipes are generally produced by centrifugal casting. In centrifugal casting, molten metal is poured into the cavity of a rapidly rotating metal mould and the metal is held against the wall of the mould by centrifugal force and solidifies in the form of pipes. The casting machine typically comprises a cylindrical steel mould surrounded by to a water jacket and liquid ductile iron is introduced with a pouring through, such casting machine is known as a DeLavaud casting machine. The mould is coated by a mould powder on the inner surface. There are several purposes of using mould powder on the inner surface of the mould, some reasons are:

- To create a thermal barrier in order to increase the mould life,
- To ease the extraction of the cast product from the mould,
- To reduce the amount of carbides formed in the cast product,
- To reduce surface defects.

U.S. Pat. No. 4,058,153 discloses a process for the production of ductile iron pipes by centrifugal casting in a rotary mould. The inner surface of the mould is coated with a mixture of silica and bentonite in suspension in water and a thin layer of powdered inoculating product. This production process is commonly denoted "wet spray" process.

In the "dry spray" process, the mould powders may be composed of a mix of several components, including an inoculant, components reducing formation of defects (especially pinholes) on cast surface and an inert mineral filler. A conventional mould powder is described in U.S. Pat. No. 7,615,095 B2 which contains ferrosilicon, CaSi, $CaF_2$ and a highly reducing metal such as Mg or Ca. However, with an excess of pure Mg, MgO (slag-inclusion) can be formed on the mould surface and this may lead to undesirable effects.

One of the main defects in ductile iron pipes are surface defects, such as pinholes. Pinholes are typically holes located in the external surface of pipes, and are generally undesirable in cast products as they may compromise the structural integrity of the cast products. In cast iron pipes pinhole defects can generate water leaking when the pipes are connected with water pressure. Pinholes are more common in pipes having small diameters, such as diameters from 80 mm to 300 mm. Also, pinholes are more frequent in ductile cast iron pipes produced with the dry spray process, compared to the wet spray process. Under certain conditions, chemical composition of the cast iron, e.g. high carbon equivalent, and pouring temperature, it is challenging to prevent the pinhole formation.

If there are a large number of pinholes on the surface of the cast pipe product, the pipe to foundries can increase the addition rate of mould powder, as such an increase of mould powder on the mould surface may reduce formation of pinholes. However, a high addition rate of the mould powder generates higher cost and may in addition lead to slag problems. There is also a risk of undissolved ferrosilicon in the cast pipe which may cause reduced mechanical properties. If increasing the rate of mould powder on the mould surface is not enough to avoid pinhole formation, the foundries typically have to replace the steel mould.

The object of the present invention is therefore to provide a mould powder for coating the internal surface of casting moulds for casting cast iron that alleviate at least some of the disadvantages discussed above.

Another object of the present invention is to provide a mould powder that prevents, or at least significantly reduces the formation of pinholes in ductile iron pipes. Another object is to provide a mould powder which reduces the number of pinholes in ductile cast iron pipes, without the above disadvantages.

SUMMARY OF INVENTION

In a first aspect, the present invention relates to a mould powder for coating the internal surface of casting moulds, comprising 10-99.5% by weight of a ferrosilicon alloy,
0.5-50% by weight of an iron sulphide, and optionally
1-30% by weight of CaSi alloy, and/or
1-10% by weight of $CaF_2$.

In an embodiment, the mould powder comprises from 50 to 95% by weight of ferrosilicon alloy and from 5 to 50% by weight of iron sulphide.

In an embodiment, the mould powder comprises from 70 to 90% by weight of ferrosilicon alloy and from 10 to 30% by weight of iron sulphide.

In an embodiment, the mould powder comprises from 50 to 70% by weight of ferrosilicon alloy and from 30 to 50% by weight of iron sulphide.

In an embodiment, the mould powder comprises
30-90% by weight of a ferrosilicon alloy;
0.5-30% by weight of an iron sulphide;
5-30% by weight of CaSi alloy; and
1-10% by weight of $CaF_2$.

In an embodiment, the iron sulphide is FeS, $FeS_2$ or a mixture thereof.

In an embodiment, the ferrosilicon alloy comprises of between 40% and 80% by weight of silicon; up to 6% by weight of calcium; up to 11% by weight of barium; up to 5% by weight of one or more of the elements: aluminium, strontium, manganese, zirconium, rare earths elements, bismuth and antimony; optionally up to 3% by weight of magnesium; optionally up to 1% by weight of titanium; optionally up to 1% by weight of lead; and balance iron and incidental impurities in the ordinary amounts.

In an embodiment, the CaSi alloy comprises 28-32% by weight calcium, balance silicon and incidental impurities in the normal amount.

In an embodiment, the particle size of the ferrosilicon alloy is between 60 μm and 0.5 mm.

In an embodiment, the particle size of the iron sulphide is between 20 μm and 0.5 mm.

In an embodiment, the mould powder is in the form of a mechanical mix or blend of the ferrosilicon alloy particles and the iron sulphide particles, and the optional CaSi alloy and $CaF_2$, in particulate form.

In an embodiment, the mould powder is in dry form, in the form of a wet slurry, or a dry or wet spray.

In a second aspect, the present invention relates to a mould coating on an internal surface of a casting mould, comprising 10-99.5% by weight of a ferrosilicon alloy, 0.5-50% by weight of an iron sulphide, and optionally 1-30% by weight of CaSi alloy, and/or 1-10% by weight of $CaF_2$.

In an embodiment, the mould coating comprises from 50 to 95% by weight of ferrosilicon alloy and from 5 to 50% by weight of iron sulphide.

In an embodiment, the mould coating comprises from 70 to 90% by weight of ferrosilicon alloy and from 10 to 30% by weight of iron sulphide.

In an embodiment, the mould coating comprises from 50 to 70% by weight of ferrosilicon alloy and from 30 to 50% by weight of iron sulphide.

In an embodiment, the mould coating comprises 30-90% by weight of a ferrosilicon alloy;

0.5-30% by weight of an iron sulphide;

5-30% by weight of CaSi alloy; and 1-10% by weight of $CaF_2$.

In an embodiment of the mould coating the iron sulphide is FeS, $FeS_2$ or a mixture thereof.

In an embodiment of the mould coating the ferrosilicon alloy comprises between 40% and 80% by weight of silicon; up to 6% by weight of calcium; up to 11% by weight of barium; up to 5% by weight of one or more of the elements: aluminium, strontium, manganese, zirconium, rare earths elements, bismuth and antimony; optionally up to 3% by weight of magnesium; optionally up to 1% by weight of titanium; optionally up to 1% by weight of lead; and balance iron and incidental impurities in the ordinary amounts.

In an embodiment of the mould coating the CaSi alloy comprises 28-32% by weight calcium, balance silicon and incidental impurities in the normal amount.

In an embodiment of the mould coating the particle size of the ferrosilicon alloy is between 60 μm and 0.5 mm.

In an embodiment of the mould coating the particle size of the iron sulphide is between 20 μm and 0.5 mm.

In an embodiment the mould coating is applied in an amount of about 0.1 to about 0.5% by weight, e.g. 0.2 to 0.4% by weight, based on the weight of cast iron introduced into the mould.

In a third aspect the present invention relates to the use of the mould powder according to the first aspect, and embodiments of the first aspect, as a coating on an internal surface of a cast mould in a process of casting ductile cast iron. The use of the mould powder according to the present invention as a coating on the internal surface of a cast mould in the casting of ductile cast iron, comprises applying the mould powder on the mould surface in the form of a dry or wet spray. The mould powder according to the present invention can be used as a coating on the internal surface of a cast mould in the casting of a ductile cast iron pipe, e.g. by a centrifugal casting process.

BRIEF DESCRIPTION OF DRAWING

FIG. 1 illustrates a cross-section of a part of a steel mould, with a layer or mould coat and a part of a ductile iron pipe.

DETAILED DESCRIPTION OF THE INVENTION

The present invention relates to a mould powder suitable for coating the internal surface of cast moulds for reducing surface defects, such as pinholes, in ductile cast iron products, especially ductile cast iron pipes casted by a centrifugal casting process. Reference is made to FIG. 1, illustrating the cross-section of a part of a mould 1 having a layer of mould powder 2 coated on its internal surface, and the ductile iron pipe 3 casted in the mould.

The present inventors found that when liquid cast iron reacts with oxides on the mould surface, gas may be formed and cause the formation of pinholes. It is thought that magnesium used in the nodularizing treatment of ductile cast iron decreases the percentage of oxygen and sulphur contained in the cast iron, which leads to an increase in the surface tension of the liquid cast iron. The gas produced in the reaction between the liquid metal and the oxides on the mould surface is not able to diffuse from the inside of the liquid metal due to the surface tension of the liquid cast iron, as a consequence the gas is trapped under the liquid surface and thereby pinholes form. The present inventors found that by adding iron sulphide in the mould powder it was possible to modify (i.e. lower) the surface tension of the liquid cast iron, and by this modification of the surface tension, trapped gases can diffuse from the liquid metal and thereby, the formation of pinholes is prevented.

The mould powder according to the present invention generally comprises 10-99.5% by weight of a ferrosilicon alloy, and 0.5-50% by weight of iron sulphide. The iron sulphide being FeS, $FeS_2$ or a mixture thereof. The mould powder may optionally to comprise 1-30% by weight of CaSi alloy, and/or 1-10% by weight of $CaF_2$.

The ferrosilicon (FeSi) alloy is an alloy of silicon and iron generally comprising between 40% by weight to 80% by weight of silicon. The silicon content may be even higher, e.g. up to 95% by weight, however such high silicon FeSi alloys are normally not used in the foundry applications. High silicon FeSi alloys may also be referred to as a silicon based alloy. The ferrosilicon alloy in the present mould powder has an inoculating effect for controlling the graphite morphology in the cast iron and reducing chill level (i.e. formation of iron carbides) in the cast product. Examples of suitable, standard grade ferrosilicon alloys are FeSi75, FeSi65 and/or FeSi45 (i.e. ferrosilicon alloys with about 75% by weight, 65% by weight or 45% by weight of silicon, respectively).

Standard grades of ferrosilicon alloys usually contain some calcium (Ca) and aluminium (Al), such as up to 2% by weight of each. The amount of calcium in the FeSi alloy in the present mould powder may however be higher, such as up to 6% by weight, or lower e.g. about 1% by weight, or about 0.5% by weight. The amount of calcium in the FeSi alloy may also be low, such as max. 0.1% by weight. The amount of aluminium in the FeSi alloy may be up to about 5% by weight. Typically, the amount of aluminium in the FeSi alloy should be between 0.3 to 5% by weight.

As is generally known in the art ferrosilicon alloy inoculants may include other elements, in addition to said Ca and Al, such as Mg, Mn, Zr, Sr, Ba, Ti, Bi, Sb, Pb, Ce, La in varying amounts depending on metallurgical conditions and effects on the cast iron. A ferrosilicon alloy suitable for the present mould powder may comprise, in addition to said calcium and aluminium, up to about 11% by weight of Ba, up to about 5% by weight of one or more of the following elements; strontium (Sr), manganese (Mn), zirconium (Zr), rare earths elements (RE), bismuth (Bi), and antimony (Sb), and balance iron and incidental impurities in the ordinary amounts. The elements Ba, Sr, Mn, Zr, RE, Bi and Sb may not be present in the FeSi alloy as alloying elements, meaning said elements are not deliberately added to the FeSi alloy, however in some FeSi alloys said elements may still be present at impurity levels, such as about 0.01% by weight. One or more of the elements Ba, Sr, Mn, Zr, RE, Bi and Sb may be present in an amount of above about 0.3% by weight in the FeSi alloy. In some cases, the amount of Ba in the ferrosilicon alloy is up to about 8% by weight. In some cases, the ferrosilicon alloy might also contain up to 3% by weight of magnesium, e.g. up to 1% by weight Mg, and/or up to 1% by weight of Ti and/or up to 1% by weight of Pb.

The iron sulphide in the mould powder is FeS, $FeS_2$ or a mixture thereof. The amount of FeS is from 0.5-50% by weight, based on the total weight of the mould powder. If the iron sulphide is $FeS_2$ the amount should preferably be up to 30% by weight, based on the total weight of the mould powder. For the mould powder according to the present invention, the iron sulphide is preferably FeS. It should be noted that the iron sulphide in the present mould powder may be a mixture of FeS and $FeS_2$. The iron sulphide significantly reduces the formation of pinholes in the cast iron surface. The presence of iron sulphide in the mould coating lowers the surface tension of the liquid iron introduced in the mould. The effect of lowered surface tension is that gas bubbles entrapped in the liquid cast iron can diffuse, hence the formation of pinholes are prevented, or at least significantly reduced. If the iron sulphide content in the mould powder is too high (more than about 50% by weight FeS, or about 30% by weight $FeS_2$), there is a risk of obtaining flake graphite instead of spheroidal graphite in the cast iron product. Therefore, the upper limit of iron sulphide is 50% by weight. If the amount of iron sulphide in the mould powder is less than 0.5% by weight, the surface tension may not be sufficiently lowered for the diffusion of gas bubbles in the liquid cast iron, thus pinholes might form. In addition, at low amounts of iron sulphide in the mould powder, such as between 0.5 and 3% by weight, it may be more challenging to obtain a homogenous blend of the mould powder. Therefore, the iron sulphide content in the mould powder is preferably at least 3% by weight.

CaSi alloy is a conventional component currently used in mould powders and has a pinhole reducing effect, as well as a slight inoculating effect. The CaSi alloy, which may also be denoted calcium silicide or calcium disilicide ($CaSi_2$) contains about 30% by weight calcium, typically 28-32% by weight, and balance silicon and incidental impurities in the normal amount. Industrial CaSi alloy usually contains Fe and Al as primary contaminants. Fe content in a standard grade CaSi alloy is typically up to about 4% by weight, and Al is typically up to about 2% by weight. Standard grade CaSi alloy typically comprises about 55 to 63% by weight Si. A high amount of CaSi alloy in the mould powder may clog the centrifugal casting die. Another disadvantage with using CaSi is that slag inclusions may form and deposit on the cast iron pipe surface, giving defects in the cast iron pipe or surface defects. Further, calcium has substantially no solubility with liquid iron and may generate oxides/sulphides. These drawbacks may reduce mould life time and lead to surface defects in the cast iron products, especially pinholes as explained above. Therefore replacing, or at least reducing the amount of the conventional CaSi alloy with iron sulphide has further advantages as iron sulphide to reduces, or does not lead to, clogging of the centrifugal cast mould. According to the present invention the mould powder may comprise between 1 and 30% by weight CaSi alloy. The CaSi alloy may be any commercial CaSi alloy comprising about 30% by weight Ca, known in the field. Mould powder according to the present invention including CaSi alloy are e.g. suitable for casting cast iron products which are less prone to pinhole formation, as such casting processes require less iron sulphide in the mould powder composition. Mould powder comprising CaSi alloy and a lower amount of iron sulphide may also be necessary when casting cast iron compositions which are more susceptible to form flake graphite in the presence of sulphur.

$CaF_2$ is also a conventional component in mould powders. $CaF_2$ reduces the melting point temperature of the slag, giving more liquid slag, which improves the surface of cast pipes. $CaF_2$ also has a pinhole-reducing effect, however the pinhole-reducing effect of $CaF_2$ is not sufficient to avoid formation of pinholes on ductile cast iron pipes. According to the present invention the mould powder may comprise between 1 and 10% by weight of $CaF_2$. Mould powder according to the present invention including $CaF_2$, possibly in addition to CaSi alloy, are e.g. suitable for casting cast iron products which are less prone to pinhole formation, as such casting processes require less iron sulphide in the mould powder composition.

As stated above, iron sulphide may replace completely or partly the CaSi alloy, which traditionally has been used as the pinhole reducing component in mould powders, thereby reducing, and even eliminating, any disadvantages associated with the presence of CaSi in such mould powder, while resulting in significantly less pinhole defects in pipe surface. A mould powder according to the present invention comprising only the FeSi alloy and iron sulphide suitably has the composition from 5 to 50% by weight of iron sulphide and from 50 to 95% by weight of FeSi alloy. Examples of suitable ranges are e.g. 10-40% by weight iron sulphide and 60-90% by weight of FeSi alloy; 10-30% by weight iron sulphide and 70-90% by weight of FeSi alloy; 30-50% by weight iron sulphide and 50-70% by weight of FeSi alloy. FeS is the preferred form of iron sulphide, however if the iron sulphide is $FeS_2$ or a mixture of the two, the relative amount of iron sulphide in the mould powder should be less compared to the FeS form of iron sulphide. If the iron sulphide is only $FeS_2$ a suitable amount is up to about 30% by weight.

The mould powder according to the present invention may additionally comprise CaSi alloy and/or $CaF_2$. Suitable mould powder compositions comprising CaSi alloy and/or $CaF_2$ in addition to FeSi alloy and iron sulphide are from 0.5 to 30% by weight of iron sulphide;
from 30 to 90% by weight of FeSi alloy;
from 5 to 30% by weight CaSi alloy; and
from 1 to 10% by weight $CaF_2$.

Examples of mould powder compositions are the following, all ratios based on % by weight, it should however be noted that these examples should not be regarded as limiting for the present invention since the mould powder composition may be varied within the ranges as defined in the Summary of Invention section above:

10% FeS+90% FeSi75
20% FeS+10% CaSi+10% $CaF_2$+60% FeSi75
30% FeS+10% CaSi+60% FeSi75
25% FeS+5% $CaF_2$+70% FeSi65
15% $FeS_2$+10% CaSi+75% FeSi45

It should be noted that the indicated FeSi75, FeSi65 and FeSi45 in the exemplified mould powder compositions, may be substituted by each other, or be a mixture of the FeSi75, FeSi65 and FeSi45 alloys.

The amount of iron sulphide included in the mould powder according to the present invention, and/or the amount of ferrosilicon alloy, e.g. FeSi45, FeSi65 or FeSi75, for use in ductile iron pipes may vary dependent on different factors. Factors influencing pinhole formation are e.g.:

The Production Process:

Currently it is common to use pure CaSi alloy only in the Wet Spray processes. In the Wet Spray process, the mixture "water+bentonite+$SiO_2$" (called wet spray) is applied on the mould steel surface and CaSi alloy powder is used on top of the wet spray layer.

The mould powder according to the present invention may be added in the wet coating, or with the powder introduced on the top of such a wet coating. For the DeLavaud process, i.e. casting process where the centrifugal metal mould is surrounded by a water jacket, it is common to use a product comprising an inoculant, $CaF_2$, $MgF_2$, and CaSi alloy as a mould coat. The present mould powder comprising iron sulphide can be used both in DeLavaud (dry spray) and wet spray processes, which processes may require different levels of iron sulphide, influenced by factors such as:

Pipe Thickness:

With a small pipe wall thickness, such as 3-4 mm, there is a high risk that pinholes will be present. With 4-20 mm, there is a medium risk, and above 20 mm, there is normally a low risk that pinholes will be present.

Amount of Residual Mg in Cast Iron Melt:

After the Mg (nodularization) treatment, there is residual Mg in the iron. At high level of Mg in the cast iron melt, normal in the production of ductile cast iron, the risk of pinhole defect formation is higher.

The amount of mould powder to cover the centrifugal casting die, depending on amount of liquid cast iron introduced into the mould.

The state of cleanliness of centrifugal casting die (amount of scale deposit inside centrifugal casting die). With scale deposits there is a risk that there will be a reaction with element fixed on the surface, and in such cases more mould powder and/or higher amounts of iron sulphide may be required.

All the components of the mould powder according to the invention are in particulate form in the micron range. The particle size of the ferrosilicon alloy particles is typically between 60 μm to 0.5 mm Typical particle size of the iron sulphide, both FeS and $FeS_2$, is between 20 μm to 0.5 mm. The particle size of CaSi alloy and $CaF_2$ should be within conventional sizing, which is in the above indicated range 20 μm to 0.5 mm. The size distribution of the mould powder is 0.063-0.5 mm with particles below 0.063 mm=0-50% and particles above 0.5 mm=0-20%.

The mould powder according to the invention is used as a mould coat on casting moulds, such as permanent moulds, and on mould inserts and/or core elements, used in casting of ductile cast iron, in order to prevent the formation of pinholes and other surface defects. The present mould powder is especially suitable for coating moulds and mould inserts used in the casting of ductile cast iron pipes, by a centrifugal casting process. The mould powder should be in the form of a mechanical mix or blend of the ferrosilicon alloy and the iron sulphide, and CaSi and/or $CaF_2$, if present. The mould powder can be applied to the internal mould surface, and the surface of any mould inserts, in dry form or in wet form as a wet slurry. The mould powder can be applied onto the mould surface, and the surface of any mould inserts, according to known methods, spraying being the conventional method. The addition rate of the present mould powder corresponds to normal addition rates, typically about 0.1 to 0.5% by to weight e.g. 0.2 to 0.4% by weight or 0.25 to 0.35% by weight, based on the weight of cast iron introduced into the mould.

The present invention also relates to a mould coating on an internal surface of a casting mould, and on any mould inserts, comprising 10-99.5% by weight of a ferrosilicon alloy, 0.5-50% by weight of an iron sulphide, and optionally 1-30% by weight of CaSi alloy, and/or 1-10% by weight of $CaF_2$. The constituents and the amounts of the constituents in the mould coating are the same as those described above in relation to the mould powder, according to the present invention. The mould coating on the internal surface of a cast iron casting mould, may be applied in an amount of about 0.1 to 0.5% by weight, e.g. 0.2 to 0.4% by weight or 0.25 to 0.35% by weight, based on the weight of cast iron introduced into the mould.

The method of producing the present mould powder comprises providing ferrosilicon alloy and iron sulphide in particulate form, and if present, providing particulate CaSi alloy and/or $CaF_2$, in the desired ratio as indicated above. Any suitable mixer for mechanically mixing/blending particulate and/or powder materials may be used. If necessary the materials may be grinded or milled to suitable particle size, according to known methods.

The mould powder according to the present invention is used as a coating on the internal surface(s) of moulds for reducing surface defects, especially pinholes, when casting ductile cast iron. The mould powder is particularly suitable for application on the internal mould surface of centrifugal casting moulds for the production of ductile cast iron pipes. The mould powder according to the present invention may be applied onto the internal mould surface in the form of a dry or a wet spray, however other application methods as generally known in the field may be used for coating the mould surface.

The present invention will be illustrated by the following examples. The examples should not be regarded as limiting for the present invention as these are meant to illustrate different embodiments of the invention and the effects of the invention.

Example 1

In this example, a conventional mould powder was compared with a mould powder according to the invention. In the trials the same casting machine was used, the same grade of ductile iron pipe, mould powder was introduced in the same manner, and in the to same addition rate. The ductile iron had the same chemical composition and pouring temperature.

REFERENCE

The conventional mould powder had the following composition, in % by weight:

25% CaSi;

10% $CaF_2$;

65% FeSi.

Composition of the FeSi was Si: 62.6-67.2 wt %; Sr: 0.6-1 wt %; Al: max. 0.5 wt %; Ca: max. 0.1 wt %; balance Fe and incidental impurities.

Invention:

The mould powder according to the present invention had the following composition, in % by weight:

20% FeS;

80% FeSi.

Composition of the FeSi was Si: 65-71 wt %; Sr: 0.3-0.5 wt %; Al: max. 1 wt %; Ca: max. 1 wt %; Ba: 0.1-0.4 wt %; Zr: 1.5-2.5 wt %; Mn: 1.4-2.3 wt %; balance Fe and incidental impurities.

The particle size of the mould powder according to the present invention was in the range 0.063 mm-0.3 mm. The mould powder was a mechanical mixture of the FeSi alloy and the iron sulphide powder, and the mould powder was applied by dry spraying on the internal mould surface.

The tests were performed under industrial conditions in a centrifugal casting machine having in order to compare the two types of mould powder; denoted Reference and Invention. For each mould powder 540 pipes were produced. The number of pinholes on the external surface of the pipes produced with the mould powder according to the present invention were half compared to the reference. The number of pinholes on the external surface of the pipes produced in the tests was counted by visual inspection.

Example 2

In this example, a conventional mould powder (Reference) was compared with a mould powder according to the invention (Invention). In the trials the same casting machine was used, the same grade of ductile iron pipe, mould powder was introduced in the same manner, and in the same addition rate 0.25%. The ductile iron had the same chemical composition and pouring temperature.

REFERENCE

The conventional mould powder had the following composition, in % by weight:

12% $CaF_2$;

88% FeSi.

Composition of the FeSi was Si: 62-69 wt %; Al: 0.55-1.3 wt %; Ca: 0.6-1.9 wt %; Ba: 0.3-0.7 wt %; Zr: 3-5 wt %; Mn: 2.8-4.5 wt %; balance Fe and incidental impurities.

Invention:

The mould powder according to the present invention had the following composition, in % by weight:

20% FeS;

80% FeSi.

Composition of the FeSi was Si: 62-69 wt %; Al: 0.55-1.3 wt %; Ca: 0.6-1.9 wt %; Ba: 0.3-0.7 wt %; Zr: 3-5 wt %; Mn: 2.8-4.5 wt %; balance Fe and incidental impurities.

The particle size of the mould powder according to the present invention was in the range 0.063 mm-0.3 mm. The mould powder was a mechanical mixture of the FeSi alloy and the iron sulphide powder, and the mould powder was applied by dry spraying on the internal mould surface.

The tests were performed under industrial conditions in a centrifugal casting machine having in order to compare the two types of mould powder; denoted Reference and Invention. Table 1 shows the test results from pipe castings using the above-identified conventional mould powder and the test results from pipe castings using the mould powder according to the invention with the above-identified composition.

TABLE 1

Composition of the mould powders

| Mould powder | Number of pipes | Rejected/Pinholes | Rejection % |
|---|---|---|---|
| Reference | 241 | 41 | 17 |
| Invention | 314 | 14 | 4.4 |

The number of pinholes on the external surface of the pipes produced in the tests was counted by visual inspection. In the produced pipes from the tests using the mould powder according to the present invention, significantly less pinholes were observed in the inspected pipe surfaces.

Thus, it has been clearly demonstrated that the pinhole defect has been significantly to reduced, with a mould powder according to the present invention containing iron sulphide.

Having described preferred embodiments of the invention it will be apparent to those skilled in the art that other embodiments incorporating the concepts may be used. These and other examples of the invention illustrated above and in the accompanying drawing are intended by way of example only, and the actual scope of the invention is to be determined from the following claims.

The invention claimed is:

1. A mould powder for coating the internal surface of one or more casting moulds, comprising 10-99.5% by weight of a ferrosilicon alloy, 3-50% by weight of an iron sulphide, and optionally 1-30% by weight of CaSi alloy, and/or 1-10% by weight of $CaF_2$.

2. Mould powder according to claim 1, wherein the mould powder comprises from 50 to 95% by weight of ferrosilicon alloy and from 5 to 50% by weight of iron sulphide.

3. Mould powder according to claim 2, wherein the mould powder comprises from 70 to 90% by weight of ferrosilicon alloy and from 10 to 30% by weight of iron sulphide.

4. Mould powder according to claim 2, wherein the mould powder comprises from 50 to 70% by weight of ferrosilicon alloy and from 30 to 50% by weight of iron sulphide.

5. Mould powder according to claim 1, wherein the mould powder comprises 30-90% by weight of a ferrosilicon alloy;

3-30% by weight of an iron sulphide;

5-30% by weight of CaSi alloy; and 1-10% by weight of $CaF_2$.

6. Mould powder according to claim 1, wherein the iron sulphide is FeS, $FeS_2$ or a mixture thereof.

7. Mould powder according to claim 1, wherein the ferrosilicon alloy comprises between 40% and 80% by weight of silicon; up to 6% by weight of calcium; up to 11% by weight of barium; up to 5% by weight of one or more of the elements: aluminum, strontium, manganese, zirconium, rare earths elements, bismuth and antimony; optionally up to 3% by weight of magnesium; optionally up to 1% by weight of titanium; optionally up to 1% by weight of lead; and balance iron and incidental impurities.

8. Mould powder according to claim 1, wherein the CaSi alloy comprises 28-32% by weight calcium, balance silicon and incidental impurities.

9. Mould powder according to claim 1, wherein the ferrosilicon alloy is in particulate form having a particle size between 60 μm and 0.5 mm.

10. Mould powder according to claim 1, wherein the iron sulphide is in particulate form having a particle size between 20 μm and 0.5 mm.

11. Mould powder according to claim 1, wherein the mould powder is in the form of a mechanical mixture or blend of the ferrosilicon alloy and the iron sulphide, and the optional CaSi alloy and $CaF_2$, in particulate form.

12. Mould powder according to claim 1, wherein the mould powder is in dry form, in the form of a wet slurry, or a dry or wet spray.

13. A mould coating on an internal surface of a casting mould, said mould coating comprising 10-99.5% by weight of a ferrosilicon alloy, 3-50% by weight of an iron sulphide, and optionally 1-30% by weight of CaSi alloy, and/or 1-10% by weight of $CaF_2$.

14. A mould coating according to claim 13, wherein the mould coating comprises from 50 to 95% by weight of ferrosilicon alloy and from 5 to 50% by weight of iron sulphide.

15. A mould coating according to claim 14, wherein the mould coating comprises from 70 to 90% by weight of ferrosilicon alloy and from 10 to 30% by weight of iron sulphide.

16. A mould coating according to claim 14, wherein the mould coating comprises from 50 to 70% by weight of ferrosilicon alloy and from 30 to 50% by weight of iron sulphide.

17. A mould coating according to claim 13, wherein the mould coating comprises 30-90% by weight of a ferrosilicon alloy;

3-30% by weight of an iron sulphide;

5-30% by weight of CaSi alloy; and 1-10% by weight of $CaF_2$.

18. A mould coating according to claim 13, wherein the iron sulphide is FeS, $FeS_2$ or a mixture thereof.

19. A mould coating according to claim 13, wherein the ferrosilicon alloy comprises between 40% and 80% by weight of silicon; up to 6% by weight of calcium; up to 11% by weight of barium; up to 5% by weight of one or more of the elements: aluminum, strontium, manganese, zirconium, rare earths elements, bismuth and antimony; optionally up to 3% by weight of magnesium; optionally up to 1% by weight of titanium; optionally up to 1% by weight of lead; and balance iron and incidental impurities.

20. A mould coating according to claim 13, wherein the CaSi alloy comprises 28-32% by weight calcium, balance silicon and incidental impurities.

21. A mould coating according to claim 13, wherein the ferrosilicon alloy is in particulate form having a particle size between 60 μm and 0.5 mm.

22. A mould coating according to claim 13, wherein the iron sulphide is in particulate form having a particle size between 20 μm and 0.5 mm.

23. A mould coating according to claim 13, wherein the mould coating is applied in an amount of about 0.1 to about 0.5% by weight, based on weight of cast iron introduced into the mould.

* * * * *